United States Patent [19]

Faulkner

[11] Patent Number: 4,760,382

[45] Date of Patent: Jul. 26, 1988

[54] RESISTANCE LOOP EQUIPMENT SECURITY SYSTEM

[75] Inventor: Peter Faulkner, Victoria, Canada

[73] Assignee: University of Victoria, Victoria, Canada

[21] Appl. No.: 862,480

[22] Filed: May 12, 1986

[30] Foreign Application Priority Data

Mar. 21, 1986 [CA] Canada ..... 504696

[51] Int. Cl.[4] ..... G08B 13/14

[52] U.S. Cl. ..... 340/572; 340/568

[58] Field of Search ..... 340/572, 568

[56] References Cited

U.S. PATENT DOCUMENTS

| | | | |
|---|---|---|---|
| 2,913,712 | 11/1959 | Lee | 340/568 |
| 3,253,270 | 5/1966 | Downer | 340/568 |
| 3,544,984 | 12/1970 | Hanson | 340/572 |
| 3,553,674 | 1/1971 | Head | 340/572 |
| 4,065,762 | 12/1977 | Walter | 340/541 |
| 4,118,700 | 10/1978 | Lenihan | 340/524 |
| 4,348,661 | 9/1982 | Lucchesi | 340/510 |
| 4,524,349 | 6/1985 | Hyatt | 340/500 |

FOREIGN PATENT DOCUMENTS 1130885 8/1982 Canada .

*Primary Examiner*—Glen R. Swann, III

*Attorney, Agent, or Firm*—Sutton, Ezra

[57] ABSTRACT

An equipment security system is provided herein which is capable of monitoring at least one security loop for detecting unauthorized removal of equipment interconnected within the security loop by means of a connecting member comprises a predetermined resistance secured in or to the equipment forming the security loop, that resistance being one arm of a resistance bridge. Such predetermined resistance has a resistance value sufficient to maintain the resistance bridge in a substantially-balanced state. The resistance bridge has a DC voltage permanently applied across one of its two pairs of diagonal terminals and has a diode bridge connected across the other of its two pairs of diagonal terminals. Means are responsive through the diode bridge for indicating an unbalanced state of the resistance bridge to indicate interruption of the security loop, thus enabling the alarm or warning system.

15 Claims, 2 Drawing Sheets

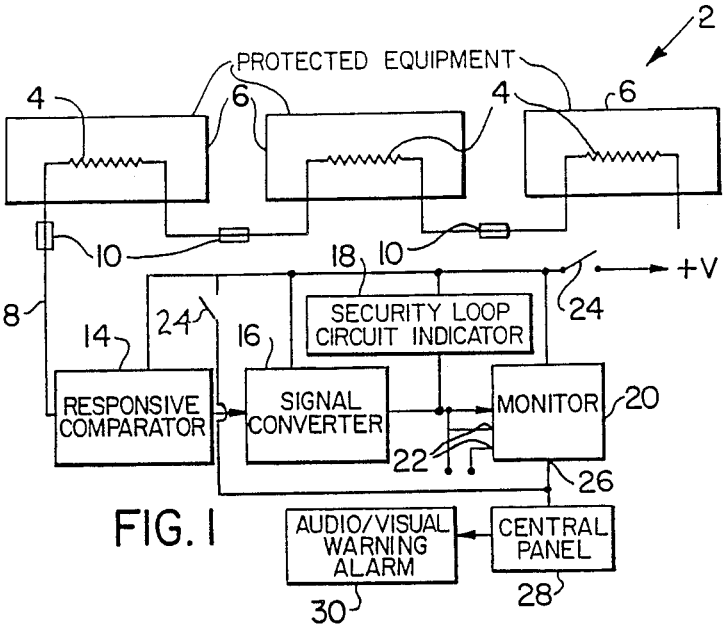
FIG. 1
FIG. 2
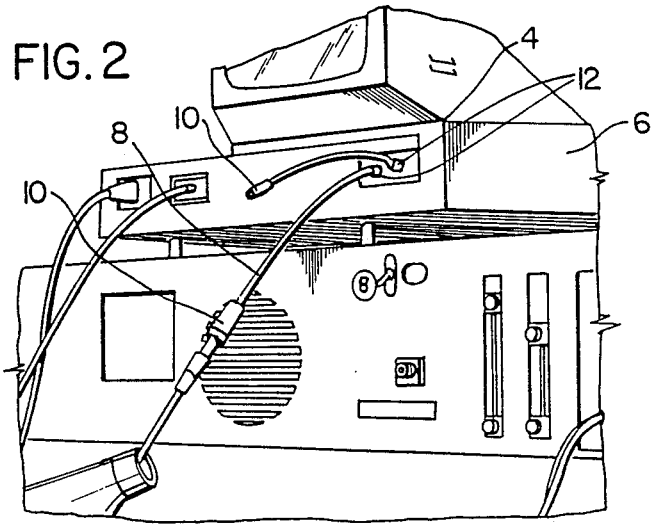

RESISTANCE LOOP EQUIPMENT SECURITY SYSTEM

BACKGROUND OF THE INVENTION

1. Field of the Invention

This invention relates to equipment security system for providing an alarm, namely, a visual and/or audible indication in response to any variation or modification of the condition of an equipment resulting from unauthorized removal of the equipment at a protected area.

2. Description of the Prior Art

It is often desirable, especially in an educational and research institute, to provide security to all circuit boards, micro-computers, terminals, peripheral devices, printers, etc. and yet at the same time provide sufficient flexibility to the users, such that the equipment may be movable and replaceable in order to meet the research requirements of the users. Hence, there is a need to provide an equipment security system whereby security could be provided to discourage unauthorized removal of the equipment and while not frustrating the user in normal application.

Various alarm systems are now known. However, many of these alarm systems suffer from a major problem in that a skillful intruder generally is able to defeat the alarm system and render it inoperative by shorting the condition sensing switches or the wires connecting the switches in a circuit. Another problem associated with sensor detector type security systems is that such systems would become inoperative because the metal body of the equipment may cause interference to the operation of the sensors. Other problems associated with the general type alarm systems is that such systems generally provide little flexibility to the users of the equipment. Hence, such systems are impractical in an educational, research environment.

In U.S. Pat. No. 4,524,349 to Hyatt, issued June 18, 1985, a security system is described using a micro-processor as a control means. The micro-processor is used to monitor the loop circuits, the generation of detector signals and the control of the alarm circuits. This security system is a complicated system and has many circuit components. Also, such system relates to an intrusion security system, flexibility may not be a prime consideration. Hence, such system may not be adopted successfully in an educational, research environment.

In U.S. Pat. No. 4,118,700 to Lenihan, issued Oct. 3, 1978, a security system is disclosed, having a single sensor loop having a plurality of detectors connected in a series, such detectors being connected in parallel with resistors of different value in order to identify the detectors. A "NAND" logic is used as an analog to digital converter having a digital detection signal output. This analog-to-digital converter having a single analog input and a plurality of comparators, is complicated and has many circuit components. Also, the Lenihan invention teaches a security system having a large number of detectors for detecting different conditions, such as smoke, fire or intrusion; hence such system would not provide the type of flexibility to the equipment users. Thus, it would not be suitable in an educational, research environment. As well, the equipment under monitor, when in operation may cause interference to the operation of the sensors or detectors. Thus, may cause unpredictable results to the security system.

U.S. Pat. No. 4,348,661 to Lucchesi, issued Sept. 7, 1982 teaches an alarm system providing improvements over the conventional bridge type alarm system. It uses operational amplifiers to detect open and/or short circuit conditions. Hence, the improvement removes the use of a complex circuit arrangement usually found in the conventional bridge type alarm systems. However, the Lucchesi system relates to a conventional burglar alarm environment for monitoring unauthorized intrusion. Hence, it would not provide the flexibility for equipment security purposes in an educational institute.

U.S. Pat. No. 4,065,762 to Walter, issued Dec. 27, 1977, teaches the use of an AC bridge instead of the conventional DC bridge for the comparator circuit in an alarm system. Such improvement introduces further security to the system in that it is much more difficult to match an AC voltage than a DC voltage in terms of phase angle between the voltage and current in an AC circuit. However, the Walter system does not provide equipment security means, and flexibility may be difficult to achieve in an AC bridge alarm system in that the connecting cable may pick up interference signals. As well, the AC current may cause interference to the operation of the equipment being monitored. In order to avoid the interference problem, complex shielding means may be necessary.

Canadian Pat. No. 1,130,885 to Dray, issued Aug. 31, 1982, discloses an AC bridge intrusion security system having reference and/or compensating elements. Again, this type of intrusion security system may not be useful in an educational institute and compensating elements may not be necessary since the equipment being monitored will be indoors and not subject to environmental changes.

SUMMARY OF THE INVENTION

Aims of the Invention

Accordingly, it is an object of the present invention to provide a low cost, flexible, simple-to-install equipment security system applicable in an educational, research environment where movability of the equipment is essential to the users of the equipment under protection.

Statements of Invention

While conventional alarm systems provide intrusion monitoring means, the present invention provides an equipment security system capable of accepting at least one security loop for detecting unauthorized removal of equipment from a designated area, such as a research facility in an education institute. The system according to the present invention, is useable in any environment where movability of the item under protection is desirable.

According to the present invention, a security system is provided which is capable of monitoring at least one security loop, for detecting unauthorized removal of equipment interconnected within the security loop, by means of a connecting member, such system comprising: (a) predetermined resistance means secured in or to the equipment forming the security loop and being one arm of a resistance bridge; the predetermined resistance means having a resistance value sufficient to maintain the resistance bridge in a substantially balanced state; the resistance bridge having a DC voltage permanently applied across one of its two pairs of diagonal terminals and having a diode bridge connected across the other of its two pairs of diagonal terminals; and means responsive through the diode bridge for indicating an unbalanced state of the resistance bridge to indicate interruption of the security loop.

OTHER FEATURES OF THE INVENTION

In a preferred embodiment of the present invention, the connecting member comprises a shielded cable, e.g., a co-axial cable The co-axial cable preferably has a connector which can be connected and disconnected only by means of a wrench.

A loop-terminating resistor is operatively associated with the shielded conductor cable and is preferably enclosed in a case of conducting material, whereby removal of the case results in triggering of the alarm means. The case preferably is formed of metal. It is preferred that the shield of the shielded conductor cable be connected to the common ground of the security loop.

The predetermined resistance means preferably comprise a fixed resistor coupled with the resistance of the connecting member. In such system, the predetermined resistance means and the resistance bridge are connected to a voltage comparator circuit, thereby to maintain a predetermined voltage level across each reference element and the security loop circuit, so that a threshold variance in the resistance of the security loop circuit activates the alarm means.

It is also preferred that the equipment security system further includes monitoring means including a display means for the security loop circuit, and a logic circuit means preferably comprising a signal convertor means and an "AND" logic circuit, whereby the voltage of the security loop circuit differing from a pre-determined voltage across the reference elements, results in a change of state in the "AND" logic circuit. The display means preferably comprises a visual display means which is adapted to reverse the display condition upon a change of state in the logic cirucit means. Preferably the visual display means is an LED display.

It is preferred that the equipment security system also include alarm means for providing warning signals upon indication of the unbalanced state, the alarm means comprising at least one of an audio signal and a visual signal upon a change of state in the logic circuit means.

The system should also include a disable means permitting the disabling of the security loop circuit under controlled condition. Such disable means also should include a locking means which, when activated, disables the monitoring means. Such locking means preferably is a key-switch for the logic circuit means.

BRIEF DESCRIPTION OF THE DRAWINGS

In the accompanying drawings:

FIG. 1 is a block diagram of one form of security loop circuit of one embodiment of the present invention;

FIG. 2 shows the connection of the security loop circuit to the equipment being monitored.

DETAILED DESCRIPTION OF THE INVENTION

Figure 3:
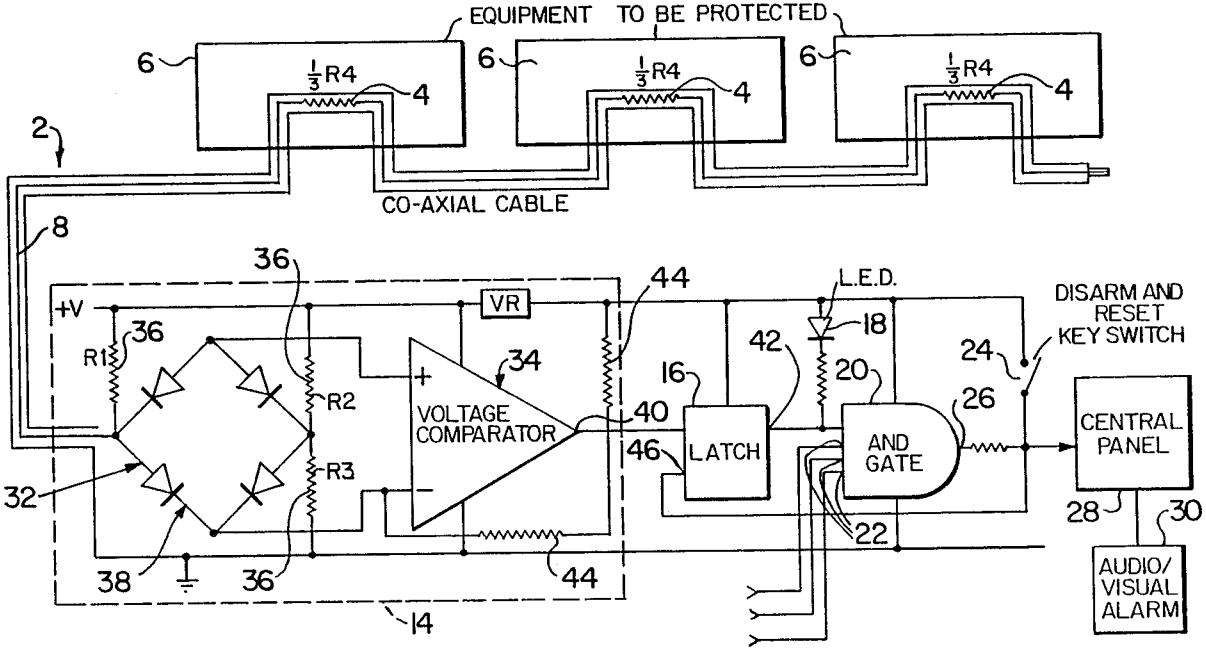
FIG. 3 is a schematic diagram of one embodiment of the present invention.

In the following description, similar features have been given similar reference numerals.

DESCRIPTION OF FIG. 1

Turning to FIG. 1, a block diagram for one form of security loop circuit of the present invention is shown. The sensing means 4, which is a fixed resistor, is placed inside the body frame of the equipment 6 under protection, such that the resistance of the fixed resistor could not be determined easily externally from the body frame of the equipment 6. There may be a plurality of equipments 6 in a particular security loop circuit 2 such that a separate sensing means 4 is installed in each individual equipment 6. The sensing means 4 is connected, either in series or in parallel to the computer means 14, by means of co-axial cable 8. The co-axial cable 8 used in the present invention may be a conventional TV 75 ohm cable and the connector 10 for the co-axial cable is of the type that can be obtained easily commercially so that the security loop circuit 2 may be set up easily and at low cost. The output of the responsive comparator 14 is connected to a signal converter means 16. The signal converter means 16 converts the analog output signal from the responsive comparator means 14 into digital signal which in turn is connected to a monitor means 20. A security loop circuit indicator 18 is provided to indicate that the state of the security loop circuit 2. Signal converter means 16 also latches an alarm condition so that the LED of the loop indicator remains "ON" even if the cause is removed.

The monitoring means 20 is capable of accepting at least one input 22; hence a plurality of security loop circuits 2 could be monitored by the security system of the present invention. The monitoring means 20 can be disabled by putting the set and disable means 24, which is a key switch, to the "DISABLE" position. The output 26 from the monitoring means 20 is connected to a central panel 28 so that status of the entire equipment security system can be monitored at one location. Audio and/or visual alarm warning system 30 can be activated automatically in a fault situation.

DESCRIPTION OF FIG. 2

FIG. 2 shows the connection of the co-axial cable 8 to the body frame of the equipment 6. It can be seen that the co-axial cable 8 can be easily connected to and disconnected from the equipment 6 since standard mounting connector 10 is easily accessible externally from the body frame of the equipment 6. In a preferred embodiment, the equipments 6 are connected in series by using straight type connectors 10. However it is anticipated that such connection is also acceptable in parallel format by using "T" type or other type of connectors.

The security loop circuit 2 is connected to a responsive comparator 14 (as seen in FIG. 1) so that the total electrical characteristics such as the resistance of the security loop circuit 2 can be monitored. In the present embodiment, the electrical characteristics of the security loop circuit 2 are determined by the total resistance of the security loop circuit 2 which includes the resistance of the fixed resistor 4 as well as the resistance of the total length of the co-axial cable 8. It can be seen that if sufficient length of the co-axial cable 8 is provided for an equipment 6, then equipment 6 can be moved around within the length of co-axial cable 8 is provided.

As well, the co-axial cable 8 is adapted to be easily disconnected from the equipment 6 so that replacement or removal of equipment 6 becomes a simple task. In addition, in the preferred embodiment the type of co-axial connector selected is one in which a wrench is required to disconnect the connector. Accordingly, the chances of an accidental open circuit are reduced to a minimum. In another preferred embodiment, moreover, the loop terminating resistor is enclosed in a case of a conducting material, e.g. a metal, which would have to be removed to measure its value. Such removal would, however, trigger the alarm. Therefore, it can be seen that the present invention provides great flexibility to the user to relocate, replace and remove equipment 6 under protection.

DESCRIPTION OF FIG. 3

In the schematic diagram of FIG. 3, the responsive comparator means 14 is shown to be provided by a diode bridge circuit 32, a resistance bridge circuit 38, and a voltage comparator circuit 34. The security loop circuit 2 forms one arm of the resistance bridge circuit 38 while fixed resistors 36 are connected to the other arms of the resistance bridge circuits 38. In theory, all four arms of the resistance bridge circuit could be separate security loops. In the preferred embodiment however, the shield of the co-axial cable must be connected to the common ground of the detector circuit, so that only the two lower arms of the resistance bridge circuit are suitable for use as security loop. The resistance bridge circuit 38 is connected to a voltage comparator circuit 34 through the diode bridge circuit 32. The function of the diode bridge circuit 32 is such that it ensures the output 40 of the voltage comparator 34 becomes low in the event of a significant change in the electrical characteristics of the security loop circuit 2 such as the resistance of the security loop circuit 2. The amount of resistance change required to activate the alarm can be regulated by adjusting the value of the negative feedback resistor 44 of the voltage comparator circuit 34.

OPERATION OF PREFERRED EMBODIMENT

In operation, when a balanced status is achieved in the resistance bridge circuit 38, the output voltage 40 of the voltage comparator circuit 34 is high which causes a "high", or "138 at output 42 at the signal converter means 16 which is a latch circuit. The output 42 of the signal converter means 16 is connected to the input 22 of an "AND" gate circuit of the monitor means 20. A "high" or "1" input 22 results in a "1" output at the monitor means 20.

When there is a significant change in the resistance of the security loop circuit 2, a "low" or "0" is caused at output 40 of the voltage comparator circuit 34. Consequently output 42 of the signal convertor circuit 16 becomes "low", or "0". A "low" or "0" at input 22 to the "AND" gate circuit of the monitoring means 20 results in a "low" or "0" output 26 in the monitoring means 20 which represents a change of status. Such a change in status will cause audio and/or visual warning system 30 to operate automatically through control signals from the central panel 28.

The monitoring means 20 is capable of accepting a plurality of inputs 22. Hence the security system of the present invention is capable of monitoring a plurality of security loop circuits 2. When all the inputs 22 to the monitoring means 20 are "high", or "1", the output 26 of the monitoring means 20 results in a "high" or "1" value. However, if at least one of the input 22 becomes "low", or "0" the output 26 of the monitoring means 20 becomes "low", or "0" which represents a change of status and will automatically activate the audio, visual warning system 30. Also, when the output 42 of the signal converter means 16 becomes "low", the voltage difference across the security loop circuit indicator 18 varies; hence an indication can be provided to identify the security loop circuit 2 which is experiencing a significant change in the resistance of the loop which may suggest an unauthorized tampering of the equipment has occurred.

In situations where an installation change such as a replacement of equipment or removal of an equipment in a particular security loop circuit 2, becomes desirable, such change may be achieved by disabling the security loop circuit 2 concerned without disabling the remaining security loop circuits 2 and maintaining the audio, and/or visual warning system 30 active.

In order temporarily to disable a particular security loop circuit 2, the key switch of the disable means 24 is put to the "DISABLE" position so that an input voltage is provided to the input 46 of the signal converter means as well as to the central panel 28 The presence of the input voltage at input 46 and at the input to the central panel 28 results in a "high", or "1" at output 42 irrespective of the output of the voltage comparactor 34. Therefore, any change in the resistance in the security loop circuit 2 will not cause a change of status in the monitoring means 20 and the audio visual warning system 30 will not be activated under this circumstance.

Upon completion of the installation change, the responsive comparator means 14 returns to a balanced condition such that the voltage comparator circuit 34 maintains an input voltage at the input 40 of the signal converter means 16. The output 42 of the signal converter means 16 remains in "high" or "1" when the disable means 24 returns to the "ENABLE" position.

Hence, it can be seen that the security system of the present invention provides a simple means to carry out installation changes without disturbing the operation of the remaining security loop circuits 2. It is also seen that the security system of the present invention is able to detect both open and short circuit conditions in the security loop circuit 2 because in either situation, there is a change in the electrical characteristics such as the resistance in the security loop circuit 2 which in turn will trigger the warning system 30. Therefore, this is an advantage of the security system of the present invention over the general conventional simple alarm loops security system which can only detect either an open circuit or a short circuit condition.

Thus, from the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims. For example, a different logic circuit would replace the "AND" logic circuit used in the monitoring means 20 in the present invention. Alternatively, an AC bridge may be used instead of the resistance bridge 38 as described in the present invention, such that the electrical characteristics of the security loop circuit 2 is measured by its impedance (resistance and reactance). Accordingly, it is intended to embrace all such alternatives, modifications and variations as fall within the spirit and broad scope of the appended claims.

I claim:

1. An equipment security system capable of monitoring at least one security loop for detecting unauthorized removal of equipment interconnected within said security loop by means of a connecting member, said system comprising: predetermined resistance means secured in or to said equipment forming said security loop and being one arm of a resistance bridge; said predetermined resistance means having resistance value sufficient to maintain said resistance bridge in a substantially balanced state; said resistance bridge having a DC voltage permanently applied across one of its two pairs of diagonal terminals and having a diode bridge connected across the other of its two pairs of diagonal terminals; and means responsive through said diode bridge for indicating an unbalanced state of said resistance bridge to indicate interruption of said security bridge.

2. An equipment security system according to claim 1 wherein said connecting member comprises a shielded conductor cable.

3. An equipment security system according to claim 2 wherein a loop-terminating resistor operatively associated with said shielded conductor cable is enclosed in a case of conducting material, whereby removal of said case results in triggering of said alarm means.

4. The equipment security system according to claim 3 wherein said case is made of metal.

5. The equipment security system according to claim 3 wherein said shielded conductor cable is a co-axial cable having a connector which can be connected and disconnected only by means of a wrench.

6. The equipment security system according to claim 2 wherein the shield of said shielded conductor cable is connected to a common ground of said security loop.

7. An equipment security system according to claim 2, wherein said predetermined resistance means comprises a fixed resistor coupled with the resistance of said connecting member.

8. An equipment security system according to claim 7, wherein said predetermined resistance means, and said resistance bridge are connected to a voltage comparator circuit, thereby to maintain a predetermined voltage level across each reference element and said security loop circuit, so that a threshold variance in the resistance of said security loop circuit activates the alarm means.

9. An equipment security system according to claim 1 further including monitoring means including a display means for said security loop circuit, and a logic circuit means, said logic circuit means comprising a signal convertor means and an "AND" logic circuit, whereby the voltage of the security loop circuit differing from a pre-determined voltage across said predetermined resistance means results in a change of state in the "AND" logic circuit.

10. An equipment security system according to claim 9, wherein said display means comprises a visual display means, said visual display means being adapted to reverse the display condition upon a change of state in the logic circuit means.

11. An equipment security system according to claim 10, wherein said visual display means is an LED display.

12. An equipment security system according to claim 9 including alarm means for providing warning signals upon indication of said unbalanced state, said alarm means providing at least one of an audio and a visual signal upon a change of state in the logic circuit means.

13. An equipment security system according to claim 9 including a disable means permitting the disabling of said security loop circuit under controlled conditions.

14. An equipment security system according to claim 13, wherein said disable means comprises a locking means which, when activated, disables said monitoring means.

15. An equipment security system according to claim 14, wherein said locking means is a key-switch for said logic circuit means.

* * * * *

UNITED STATES PATENT AND TRADEMARK OFFICE

CERTIFICATE OF CORRECTION

PATENT NO. : 4,760,382

DATED : July 26, 1988

INVENTOR(S) : Peter Faulkner

It is certified that error appears in the above-identified patent and that said Letters Patent is hereby corrected as shown below:

Column 3, line 9, after "cable", insert a period.(1st occurr.)

Column 5, line 42, change ""138" to --"1"--.

Column 6, line 20, after "28", insert a period.

Signed and Sealed this

Thirteenth Day of June, 1989

*Attest:*

DONALD J. QUIGG

*Attesting Officer*

*Commissioner of Patents and Trademarks*